US006763879B1

(12) United States Patent
Macheske et al.

(10) Patent No.: US 6,763,879 B1
(45) Date of Patent: Jul. 20, 2004

(54) MOLD TEMPERATURE CONTROL FOR CASTING SYSTEM

(75) Inventors: Robert L. Macheske, Tawas City, MI (US); Thomas J. H. Rozich, Au Gres, MI (US); David Good, Chelsea, MI (US); Alan P. Gould, Tawas City, MI (US); Daniel D. Minor, Cadillac, MI (US); Kenneth D. McKibben, Defiance, OH (US); Diane M. Zekind, Farmington Hills, MI (US); Karl D. Voss, Standish, MI (US); David J. Gillette, Grandville, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/186,539

(22) Filed: Jul. 1, 2002

(51) Int. Cl.[7] ..... B22D 46/00

(52) U.S. Cl. ..... 164/458; 164/348; 164/154.6; 164/155.6; 164/122

(58) Field of Search ..... 164/458, 348, 164/154.6, 155.6, 122

(56) References Cited

U.S. PATENT DOCUMENTS 3,583,467 A * 6/1971 Bennett ..... 164/458
3,620,295 A 11/1971 Dain ..... 164/443
4,483,387 A 11/1984 Chielens et al. ..... 164/455
4,660,619 A 4/1987 Nettelbeck et al. ..... 164/455
5,215,141 A 6/1993 Kuhn et al. ..... 164/457
5,452,999 A * 9/1995 Evans ..... 425/144
6,089,308 A 7/2000 Roder et al. ..... 164/455
6,312,628 B1 * 11/2001 Wieder et al. ..... 264/37.27

* cited by examiner

*Primary Examiner*—Kiley Stoner
*Assistant Examiner*—I.-H. Lin
(74) *Attorney, Agent, or Firm*—MacMillan, Sobanski & Todd, LLC

(57) ABSTRACT

A mold temperature control system comprises a mold section having a cavity, a fluid circuit to distribute a flow of a conditioning fluid, the fluid circuit being positioned spaced apart from the cavity, a temperature sensor positioned in the mold to generate a signal representative of a temperature in the mold, a controllable supply of the conditioning fluid, and a controller for automatically initiating flow of the conditioning fluid through the fluid circuit in response to an initiation temperature and for automatically terminating flow of the conditioning fluid through the fluid circuit in response to a termination temperature.

9 Claims, 3 Drawing Sheets

MOLD TEMPERATURE CONTROL FOR CASTING SYSTEM

BACKGROUND OF THE INVENTION

This invention relates in general to controlling mold temperature in a casting system to produce a cast article. Pressure pouring of molten metal from a furnace to fill a mold cavity has been used for several decades. At room temperature, the metal is solid and becomes fluidic when melted with sufficient heat.

It is known to use a low pressure countergravity casting apparatus to cast molten metal into a mold. One example of such an apparatus is described in U.S. Pat. No. 5,215,141. Basically, in a low pressure countergravity casting apparatus, molten metal is supplied to a machine furnace. The machine furnace includes a supply conduit for introducing a gas under pressure into the machine furnace. As the gas is introduced into the machine furnace, the molten metal in the machine furnace is forced through a submerged feed tube, or evacuation conduit, into the mold. The evacuation conduit is commonly referred to as a stalk tube. The mold receives the molten metal through holes in the bottom of the mold.

The molten metal must cool in the mold and harden to produce the cast article. Cooling of the molten metal is generally done by cooling the mold using a cooling fluid flowing through cooling channels in the mold. Conventionally, cooling of the mold has been controlled by a skilled human operator who adjusts the flow of the cooling fluid, which has been rather imprecise. Insufficient cooling times can lead to an improperly formed cast article. Excessive cooling time leads to decreased cycle times and economic inefficiency.

In order to make a solid cast article with the best possible structural properties in the least amount of time, the mold temperature during metal filling and during cooling must be accurately controlled regardless of environmental conditions (e.g., ambient air temperature, humidity, and temperature and pressure of the cooling fluid). During casting, the heat energy of the molten metal (e.g., aluminum) flows into the mold and then into the cooling fluid. Preferably, a temperature profile is achieved such that a directional solidification of the cast article occurs wherein the article solidifies from the outside and then in towards the filling area (i.e., stalk tube). After a solidified article is removed from the mold, it is prepared as quickly as possible for casting another part. This includes ensuring that the mold starts the next cycle at a predetermined temperature. Thus, it is desired to cool a mold as quickly as possible while maintaining acceptable structural properties of the article and providing directional solidification.

SUMMARY OF THE INVENTION

The above advantages as well as other advantages not specifically enumerated are achieved by a mold temperature control system comprising a mold section having a cavity, a fluid circuit to distribute a flow of a conditioning fluid, the fluid circuit being positioned spaced apart from the cavity, a temperature sensor positioned in the mold to generate a signal representative of a temperature in the mold, a controllable supply of the conditioning fluid, and a controller for automatically initiating flow of the conditioning fluid through the fluid circuit in response to an initiation temperature and for automatically terminating flow of the conditioning fluid through the fluid circuit in response to a termination temperature.

Various advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
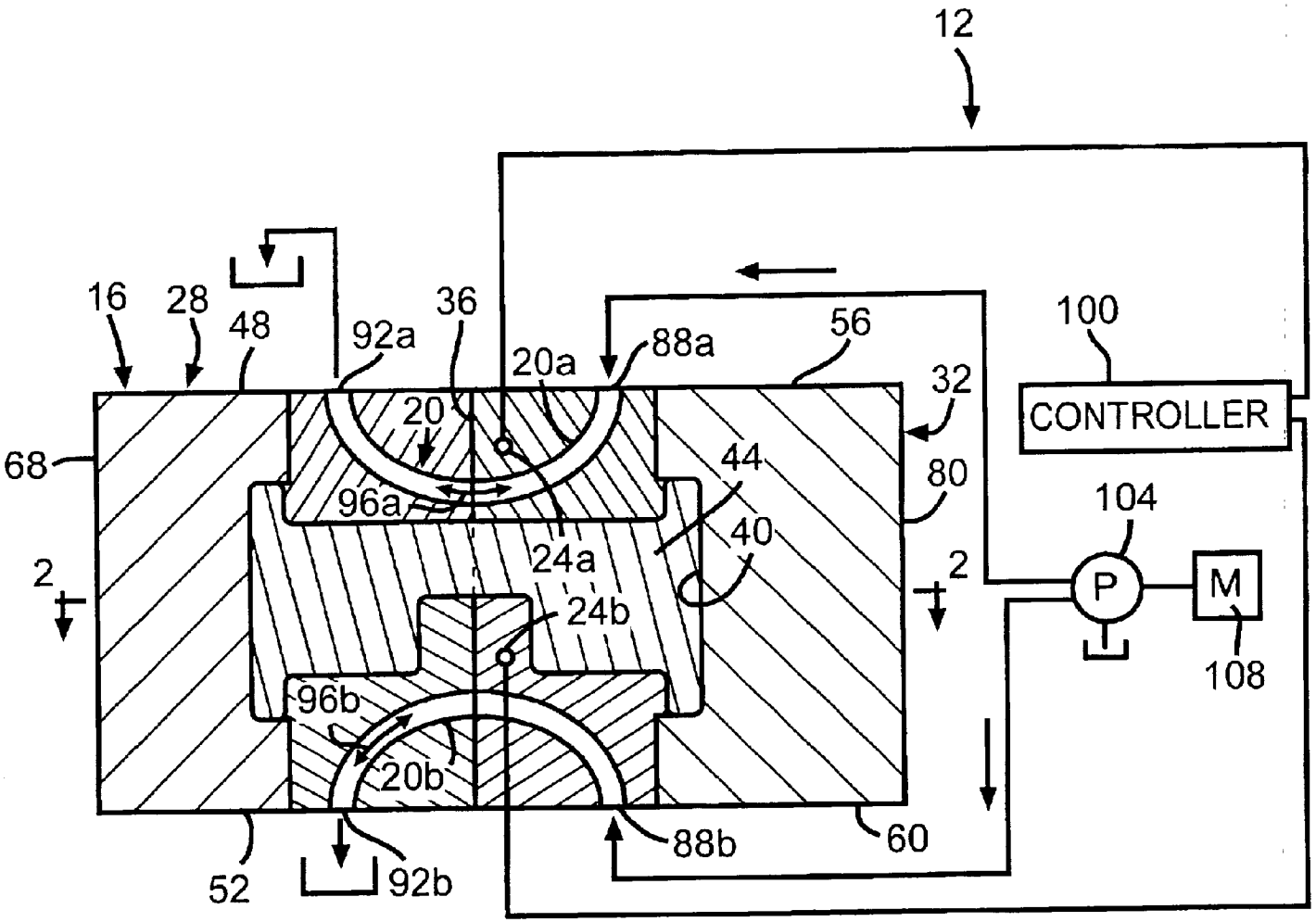
FIG. 1 is a cross-sectional schematic of a mold temperature control system according to the invention.

Terms indicating direction may be used in this application. For example, the terms "upper," "lower," and "side", may be used for the purpose of facilitating discussion of the figures under discussion and are not a limitation on the invention or the use or orientation of the invention. Referring now to the figures, a mold temperature control system, indicated generally at 12, is illustrated in accordance with the present invention. Although this invention will be described and illustrated in conjunction with the particular mold disclosed herein, it will be appreciated that this invention may be used in conjunction with other molds. The general structure and operation of the mold is conventional in the art. Thus, only those portions of the mold which are necessary for a full understanding of this invention will be explained and illustrated in detail. In the illustrated embodiment, the mold temperature control system 12 includes a mold 16, at least one fluid circuit 20 *a–f*, and at least one temperature sensor 24 *a–e*.

The illustrated mold 16 includes a first mold section 28 and a second mold section 32. The mold 16 may include any suitable number of mold sections. For the illustrated mold 16, the first mold section 28 and the second mold section 32 are positioned to meet at a part line 36 when the mold 16 is in a closed position, as illustrated. The first mold section 28 and the second mold section 32 cooperate to define a cavity 40. The illustrated cavity 40 is in the general shape of a wheel. The wheel is a cast article 44. It should be understood that the mold temperature control system 12 may be used to manufacture other types of the cast article 44 in addition to the wheel and is not limited to the manufacture of wheels. The illustrated first mold section 28 includes an upper surface 48 and a lower surface 52. The illustrated second mold section 32 includes an upper surface 56 and a lower surface 60. The illustrated first mold section 28 includes side surfaces 64, 68, 72. The illustrated second mold section 32 includes side surfaces 76, 80, 84. It will be appreciated that the side surfaces 64, 68, 72, 76, 80, 84 are external surfaces of the mold 16. Likewise, the surfaces 48, 52, 56 and 60 are external surfaces of the mold 16.

Figure 2:
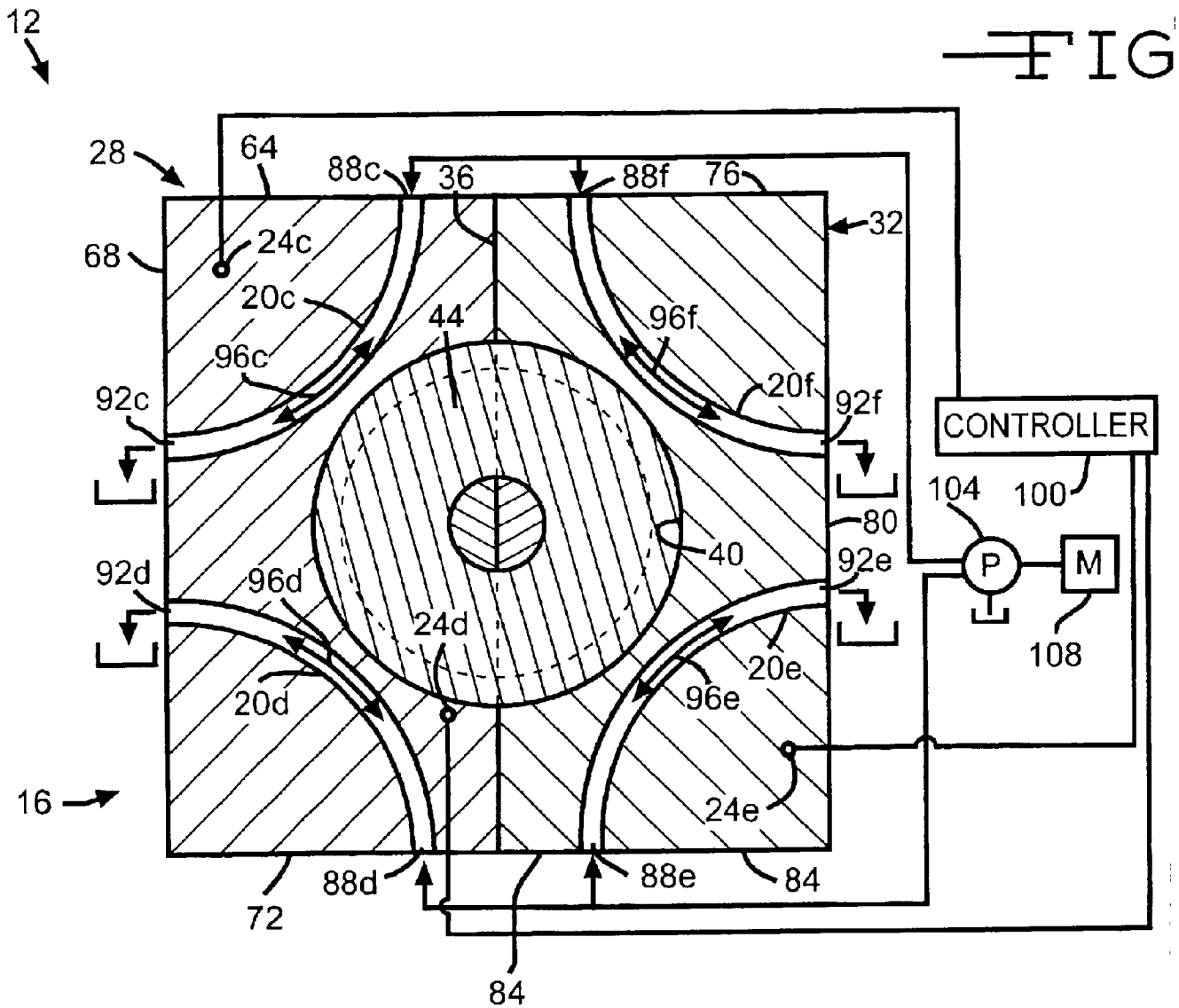
FIG. 2 is a plan schematic of a mold temperature control system according to the invention.

The illustrated mold temperature control system 12 includes six fluid circuits 20 *a–f*, although any suitable number of the fluid circuits may be employed. It should be noted that the fluid circuits 20 *a–f* may be positioned within the mold temperature control system 12 other than as illustrated. The type, number and positioning of the fluid circuits can vary with a number of factors, including but not limited to the configuration of the mold 16, the cavity 40 and the cast article 44 to be produced. FIGS. 1 and 2 illustrate one potential positioning of the fluid circuits. The fluid circuits may be of the bubbler type or of the galley type, for example. Depending upon the needs of a particular application (e.g., temperature profiles desired in a particular mold), the conditioning fluid may be either cooled or heated in order to control the temperature of mold 16. Different temperature zones within the mold can also be established with different controlled temperatures to assist in directional solidification, and with selective application of heating or cooling fluid within different zones.

It will be appreciated that the fluid circuit 20*a* is positioned for fluid flow between the upper surface 48 of the first mold section 28 and the upper surface 56 of the second mold section 32, although the fluid circuit 20*a* need not be so positioned. For example, the fluid circuit 20*a* might be positioned for fluid flow between two portions of the upper surface 48 of the first mold section 28 or two portions of the upper surface 56 of the second mold section 32. It will also be appreciated that the fluid circuit 20*b* is positioned for fluid flow between the lower surface 52 of the first mold section 28 and the lower surface 60 of the second mold section 32, although the fluid circuit 20*b* need not be so positioned. For example, the fluid circuit 20*b* might be positioned for fluid flow between two portions of the lower surface 52 of the first mold section 28 or two portions of the lower surface 60 of the second mold section 32.

It will be appreciated that the fluid circuit 20*c* is positioned for fluid flow between the side surface 64 and the side surface 68 of the first mold section 28. It will also be appreciated that the fluid circuit 20*d* is positioned for fluid flow between the side surface 72 and the side surface 68 of the first mold section 28. It will be appreciated that the fluid circuit 20*e* is positioned for fluid flow between the side surface 84 and the side surface 80 of the second mold section 32. It will also be appreciated that the fluid circuit 20*f* is positioned for fluid flow between the side surface 76 and the side surface 80 of the second mold section 32. The illustrated positioning of the fluid circuits is not intended to be limiting on the invention, but merely illustrative of one possible positioning of the fluid circuits.

The fluid circuits 20 *a–f* preferably include first openings 88 *a–f*. The fluid circuits 20 *a–f* also preferably include second openings 92 *a–f* . The first openings 88 *a–f* may be fluid inlets or fluid outlets as desired. The second openings 92 *a–f* may also be fluid inlets or fluid outlets as desired. The first openings 88 *a–f* and the second openings 92 *a–f* permit fluid flow. A pump 104 may be employed to distribute a conditioning fluid through the fluid circuits 20 *a–f*. The conditioning fluid may be any suitable fluid, such as for example water, oil, liquid or the like. The conditioning fluid may be also be any suitable gas. The conditioning fluid may be also be any suitable solid having fluidic characteristics. The conditioning fluid may move through the fluid circuits 20 *a–f* from the first openings 88 *a–f* to the second openings 92 *a–f*, as indicated by the arrows 96 *a–f*. The conditioning fluid may also move through the fluid circuits 20 *a–f* from the second openings 92 *a–f* to the first openings 88 *a–f*, as indicated by the arrows 96 *a–f*. Any fluid circuits may be positioned for fluid communication with any other one or more fluid circuits. The fluid circuits distribute a flow of the conditioning fluid. Although the illustrated fluid circuits 20 *a–f* are generally arc shaped, they may include one or more straight portions, serpentine portions or may have any other suitable shape.

The mold temperature control system 12 may include any suitable number of the one or more temperature sensors 24 *a–e*. The temperature sensor may be a thermocouple, a resistance temperature device (RTDs), a thermistor, an infrared thermometer or the like. The temperature sensor is preferably a K-type thermocouple. In a preferred embodiment, one or more of the temperature sensor generates a signal representative of the temperature at respective locations within the mold 16. For purposes of clarity, the mold temperature control system 12 will be discussed concerning an embodiment which includes five temperature sensors 24 *a–e*. The type, number and positioning of the temperature sensors can vary with a number of factors, including but not limited to the configuration of the mold 16, the cavity 40 and the cast article 44 to be produced. FIGS. 1 and 2 illustrate one potential positioning of the temperature sensors 24 *a–e*.

Various positions for the temperature sensors are contemplated with the mold temperature control system 12. It will be noted that the temperature sensors 24*a*, 24*c*, 24*e* may be positioned between an external surface of the mold 16 and one or more fluid circuits 20 *a–f* of the mold 16. It will also be noted that the temperature sensor 24*d* may be positioned between one or more of the external surfaces of the mold 16 and the cavity 40 of the mold 16. It will likewise be noted that the temperature sensor 24*b* may be positioned between the cavity 40 of the mold 16 and one or more fluid circuits 20 *a–f* of the mold 16. In a preferred embodiment, the temperature sensors are spaced apart from one or more of the external surfaces of the mold 16 by a distance within the range of from about 17 mm to about 21 mm, more preferably a distance of about 19 mm. Likewise, in a preferred embodiment the temperature sensors are spaced apart from the one or more fluid circuits 20 *a–f* by a distance within the range of from about 17 mm to about 21 mm, more preferably a distance of about 19 mm. Similarly, in a preferred embodiment the temperature sensors are spaced apart from the cavity 40 by a distance within the range of from about 17 mm to about 21 mm, more preferably a distance of about 19 mm.

Due to the spacing of a temperature sensor from a mold surface heated by molten metal and a fluid circuit cooled by the fluid, temperature changes at those surfaces are not sensed until after a time lag of up to about 10 seconds. A highly preferred location for one or more temperature sensors is a location approximately equidistant between the cavity 40 and a fluid circuit 20, such that the temperature sensor is equally affected by such temperature changes.

The mold temperature control system 12 may include a controller 100. In a preferred embodiment, the controller 100 is operative to detect when a portion of the mold 16 reaches an initiation temperature and a termination temperature. The initiation temperature and the termination temperature are temperatures that are approximately proportional to the signal representative of the temperature in the mold 16 being generated by one or more of the temperature sensors 24 *a–e* . The initiation temperature is a predetermined temperature at which the conditioning fluid preferably begins to flow through at least one of the fluid circuits 20 *a–f*. It should be noted that each of the fluid circuits 20 *a–f* may be positioned to coincide with the same or a different initiation temperature. The termination temperature is a predetermined temperature at which the conditioning fluid preferably ceases to flow through at least one of the fluid circuits 20 *a–f*. It should be noted that each of the fluid circuits 20 *a–f* may be positioned to coincide with the same or a different termination temperature.

It should be noted that each of the temperature sensors 24 *a–e* may be positioned to coincide with the same or a different initiation temperature. Likewise, it should be noted that each of the temperature sensors 24 *a–e* may be positioned to coincide with the same or a different termination temperature. It will be appreciated that at least one of the temperature sensors 24 *a–e* preferably generates a signal representative of the initiation temperature. Likewise, it will be appreciated that at least one of the temperature sensors 24 *a–e* preferably generates a signal representative of the termination temperature.

The temperature sensor is operative to cooperate with the fluid circuits to provide cooling of the mold 16. Likewise, the temperature sensor is operative to cooperate with the fluid circuits to control directional solidification of the cast article 44. Further, the temperature sensor is operative to cooperate with the fluid circuits to bring the mold 16 to an acceptable temperature for the addition of the molten metal to the cavity 40.

The controller 100 is preferably operatively connected to a pump 104 and a motor 108. The pump 104 and the motor 108 are operative to provide the conditioning fluid to the fluid circuits 20 *a–f* in the mold 16. One or more automatically-controlled valves may also be provided that can be adjusted by controller 100 in order to direct fluid flow to individual fluid circuits. In operation of a preferred embodiment, the signal representative of a temperature in the mold 16 controls the flow of the conditioning fluid in one or more of the fluid circuits 20 *a–f*. Thus, when the initiation temperature is achieved, the conditioning fluid begins to flows through one or more of the fluid circuits 20 *a–f* in the mold 16. Likewise, when the termination temperature is achieved, the conditioning fluid ceases to flow through one or more of the fluid circuits 20 *a–f* in the mold 16. The controller 100 may also be employed to synchronize the flow of the conditioning fluid through the one or more of fluid circuits 20 *a–f*.

Figure 3:
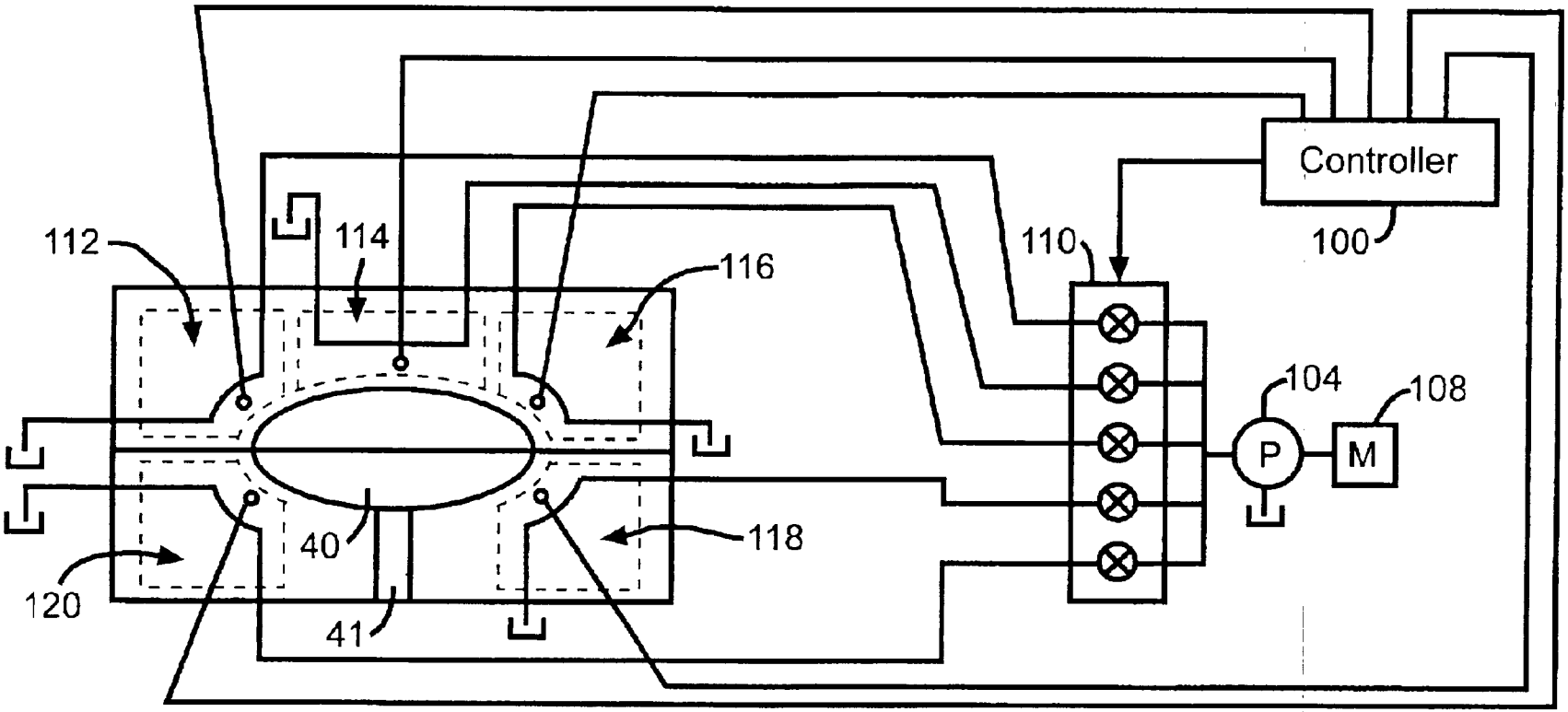
FIG. 3 is a plan schematic of a zone temperature control system according to the present invention.

FIG. 3 shows an embodiment of the invention wherein automatically-controlled valves 110 selectively direct conditioning fluid to respective temperature zones established within the mold. Each zone 112, 114, 116, 118, and 120 has a respective fluid circuit and a respective thermocouple. Each zone has a respective initiation and termination temperature used by controller 100 to maintain each temperature zone within a desired temperature range. Controller 100 separately controls each individual cooling/heating circuit by individually adjusting (e.g., turning on and off) each respective valve 110. The temperature ranges in each zone may change at different times within a manufacturing cycle (e.g., one temperature range used during article solidification and another temperature range used during mold preparation for molten metal pouring). Furthermore, different zones may be controlled at different temperatures simultaneously to provide a desired temperature profile. During solidification of a cast article in cavity 40, for example, the preferred directional solidification takes place so that solidification at portions within cavity 40 that are the most remote from stalk tube 41 occurs first. Thus, zones 112 and 116 are controlled to a lower temperature than zone 114, for example. The configuration of cooling/heating zones can be adapted to each specific mold design and can achieve substantially any desired directional solidification pattern. Since a respective temperature sensor is used to control each respective zone created in the mold by the respective fluid circuits, a controlled temperature environment is provided so that consistently high quality cast articles can be produced with optimum cycle times.

The principle and mode of operation of this invention have been described in its preferred embodiments. However, it should be noted that this invention may be practiced otherwise than as specifically illustrated and described without departing from its scope.

What is claimed is:

1. A mold temperature control system for controlling mold temperature in a countergravity casting system to assist in directional solidification in producing a cast article comprising:

a mold section having a cavity and a stalk tube;

a plurality of individual selectively controllable temperature zones established within the mold section, each of the plurality of individual selectively controllable temperature zones having a respective fluid circuit to distribute a flow of a conditioning fluid therethrough and a respective initiation and termination temperature, each respective fluid circuit being positioned spaced apart from the cavity;

at least one temperature sensor positioned in the mold in each of the plurality of individual selectively controllable temperature zones for generating a respective signal representative of a temperature in each of the plurality of individual selectively controllable temperature zones;

a controllable supply of the conditioning fluid to each of the respective fluid circuits of each of the plurality of individual selectively controllable temperature zones, the conditioning fluid can be either cooled or heated in order to control the temperature in each of the plurality of individual selectively controllable temperature zones; and a controller for automatically initiating flow of the conditioning fluid through each of the respective fluid circuits in response to an initiation temperature and for automatically terminating flow of the conditioning fluid through each of the respective fluid circuits in response to a termination temperature to thereby maintain each of the plurality of individual selectively controllable temperature zones within a desired temperature range to thereby assist in the directional solidification of the cast article;

wherein during the solidification of the cast article in the cavity the directional solidification takes place first at the respective plurality of individual selectively controllable temperature zones in the mold section that are the most remote from the stalk tube.

2. The mold temperature control system of claim 1 wherein the temperature sensor is a thermocouple.

3. The mold temperature control system of claim 1 further comprising an external surface of the mold wherein the at least one temperature sensor is positioned between an external surface of the mold and the respective fluid circuit of the mold in each of the plurality of individual selectively controllable temperature zones.

4. The mold temperature control system of claim 1 further comprising an external surface of the mold wherein the at least one temperature sensor is positioned between an external surface of the mold and the cavity of the mold in each of the plurality of individual selectively controllable temperature zones.

5. The mold temperature control system of claim 1 wherein the at least one temperature sensor is positioned between the cavity of the mold and each of the respective fluid circuits of each of the plurality of individual selectively controllable temperature zones.

6. The mold temperature control system of claim 5 wherein the al least one temperature sensor is located substantially equidistant from the cavity of the mold and each of the respective fluid circuits of each of the plurality of individual selectively controllable temperature zones.

7. The mold temperature control system of claim 5 wherein the at least one temperature sensor is spaced apart from the cavity by a distance within the range of from about 17 mm to about 21 mm.

8. The mold temperature control system of claim 5 wherein the at least one temperature sensor is spaced apart from each of the respective fluid circuits by a distance within the range of from about 17 mm to about 21 mm.

9. A method for casting an article using a mold temperature control system for controlling mold temperature in a countergravity casting system to assist in directional solidification in producing the cast article, the method comprising the steps of:

(a) providing a mold section having a cavity and a stalk tube;

(b) providing a plurality of individual selectively controllable temperature zones established within the mold section each having a respective fluid circuit to distribute a flow of a conditioning fluid therethrough and a respective initiation and termination temperature, each respective fluid circuit being positioned spaced apart from the cavity;

(c) providing at least one temperature sensor positioned in the mold in each of the plurality of individual selectively controllable temperature zones for generating a respective signal representative of a temperature in each of the plurality of individual selectively controllable temperature zones;

(d) providing a controllable supply of the conditioning fluid to each of the respective fluid circuits of each of the plurality of individual selectively controllable temperature zones, the conditioning fluid can be either cooled or heated in order to control the temperature in each of the plurality of individual selectively controllable temperature zones; and (e) providing a controller for automatically initiating flow of the conditioning fluid through each of the respective fluid circuits in response to an initiation temperature and for automatically terminating flow of the conditioning fluid through each of the respective fluid circuits in response to a termination temperature to thereby maintain each of the plurality of individual selectively controllable temperature zones within a desired temperature range to thereby assist in the directional solidification of the cast article;

wherein during the solidification of the cast article in the cavity the directional solidification takes place first at the respective plurality of individual selectively controllable temperature zones in the mold section that are the most remote from the stalk tube.

* * * * *